US010674836B1

(12) United States Patent
Woodard

(10) Patent No.: US 10,674,836 B1
(45) Date of Patent: Jun. 9, 2020

(54) INFANT CRIB WITH SAFETY MEASURES INTEGRATED THEREIN

(71) Applicant: Alexis Woodard, Irvington, NJ (US)

(72) Inventor: Alexis Woodard, Irvington, NJ (US)

( * ) Notice: Subject to any disclaimer, the term of this patent is extended or adjusted under 35 U.S.C. 154(b) by 392 days.

(21) Appl. No.: 15/695,081

(22) Filed: Sep. 5, 2017

(51) Int. Cl.
*A47D 15/00* (2006.01)
*A47D 7/01* (2006.01)
*A47D 9/00* (2006.01)

(52) U.S. Cl.
CPC ..... *A47D 15/008* (2013.01); *A47D 7/01* (2013.01); *A47D 9/00* (2013.01)

(58) Field of Classification Search
CPC ..... A47D 15/008; A47D 7/01; A47D 9/00
See application file for complete search history.

(56) References Cited

U.S. PATENT DOCUMENTS 2,109,267 A * 2/1938 Grosser ..... A47D 7/007 5/2.1
2,455,340 A * 11/1948 Newman ..... A47C 21/08 5/425
2,483,938 A * 10/1949 Royston ..... A47D 7/01 5/93.1
2,501,309 A * 3/1950 Braver ..... A47B 83/00 5/308
D165,641 S * 1/1952 Feldman ..... D6/391
2,635,257 A * 4/1953 Kroll ..... A47D 7/02 5/100
2,721,336 A * 10/1955 Becker ..... A47D 7/007 5/2.1
2,787,007 A * 4/1957 Erdkamp ..... A47D 7/007 5/2.1
3,430,272 A * 3/1969 Thorn, Jr. ..... A47D 7/02 5/93.1
3,821,822 A * 7/1974 Borreggine ..... A47C 29/003 5/109
4,450,597 A * 5/1984 Hull ..... A47C 19/20 5/2.1
5,067,183 A * 11/1991 Urquiola ..... A47D 7/01 5/183
5,926,870 A * 7/1999 Branca-Barnes ..... A47D 7/02 5/100
6,055,690 A * 5/2000 Koenig ..... A47D 15/001 5/424

(Continued)

FOREIGN PATENT DOCUMENTS

EP 2292124 B1 7/2014

*Primary Examiner* — Robert G Santos
*Assistant Examiner* — Rahib T Zaman

(57) ABSTRACT

The infant crib with safety measures integrated therein is an item of furniture adapted for use with a child. The infant crib with safety measures integrated therein comprises a crib, an end cabinet, and an entertainment center. The infant crib with safety measures integrated therein is designed to sit directly on a supporting surface such that the severity and risk of a fall are reduced. The interior surfaces of the pen of the crib are lined with a silicone gel padding that reduces the probability of an impact injuries. The silicone gel padding further reduces injury risk by discouraging chewing along the edges of the infant crib with safety measures integrated therein. The end cabinet provides storage space for used near the infant crib with safety measures integrated therein. The entertainment center is a collection of stimuli that aid in a child's development.

18 Claims, 7 Drawing Sheets

(56) References Cited

U.S. PATENT DOCUMENTS

| | | | | |
|---|---|---|---|---|
| 6,721,969 | B1 * | 4/2004 | Lupo | A47C 17/86<br>5/9.1 |
| 6,742,751 | B1 * | 6/2004 | DeMoor | A47D 7/00<br>248/345.1 |
| 8,256,041 | B1 * | 9/2012 | Girdwain | A47D 9/00<br>5/93.1 |
| 2008/0098520 | A1 * | 5/2008 | Miller | A47D 7/007<br>5/93.1 |

* cited by examiner

INFANT CRIB WITH SAFETY MEASURES INTEGRATED THEREIN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including furniture especially adapted for children, more specifically, a child's bed combined with other nursery furniture.

SUMMARY OF INVENTION

The infant crib with safety measures integrated therein is an item of furniture adapted for use with a child. The infant crib with safety measures integrated therein comprises a crib, an end cabinet, and an entertainment center. The infant crib with safety measures integrated therein is designed to sit directly on a supporting surface such that the severity and risk of a fall are reduced. The interior surfaces of the pen of the crib are lined with a silicone gel padding that reduces the probability of an impact injuries. The silicone gel padding further reduces injury risk by discouraging chewing along the edges of the infant crib with safety measures integrated therein. The end cabinet provides storage space for used near the infant crib with safety measures integrated therein. The entertainment center is a collection of stimuli that aid in a child's development.

These together with additional objects, features and advantages of the infant crib with safety measures integrated therein will be readily apparent to those of ordinary skill in the art upon reading the following detailed description of the presently preferred, but nonetheless illustrative, embodiments when taken in conjunction with the accompanying drawings.

In this respect, before explaining the current embodiments of the infant crib with safety measures integrated therein in detail, it is to be understood that the infant crib with safety measures integrated therein is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the infant crib with safety measures integrated therein.

It is therefore important that the claims be regarded as including such equivalent construction insofar as they do not depart from the spirit and scope of the infant crib with safety measures integrated therein. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
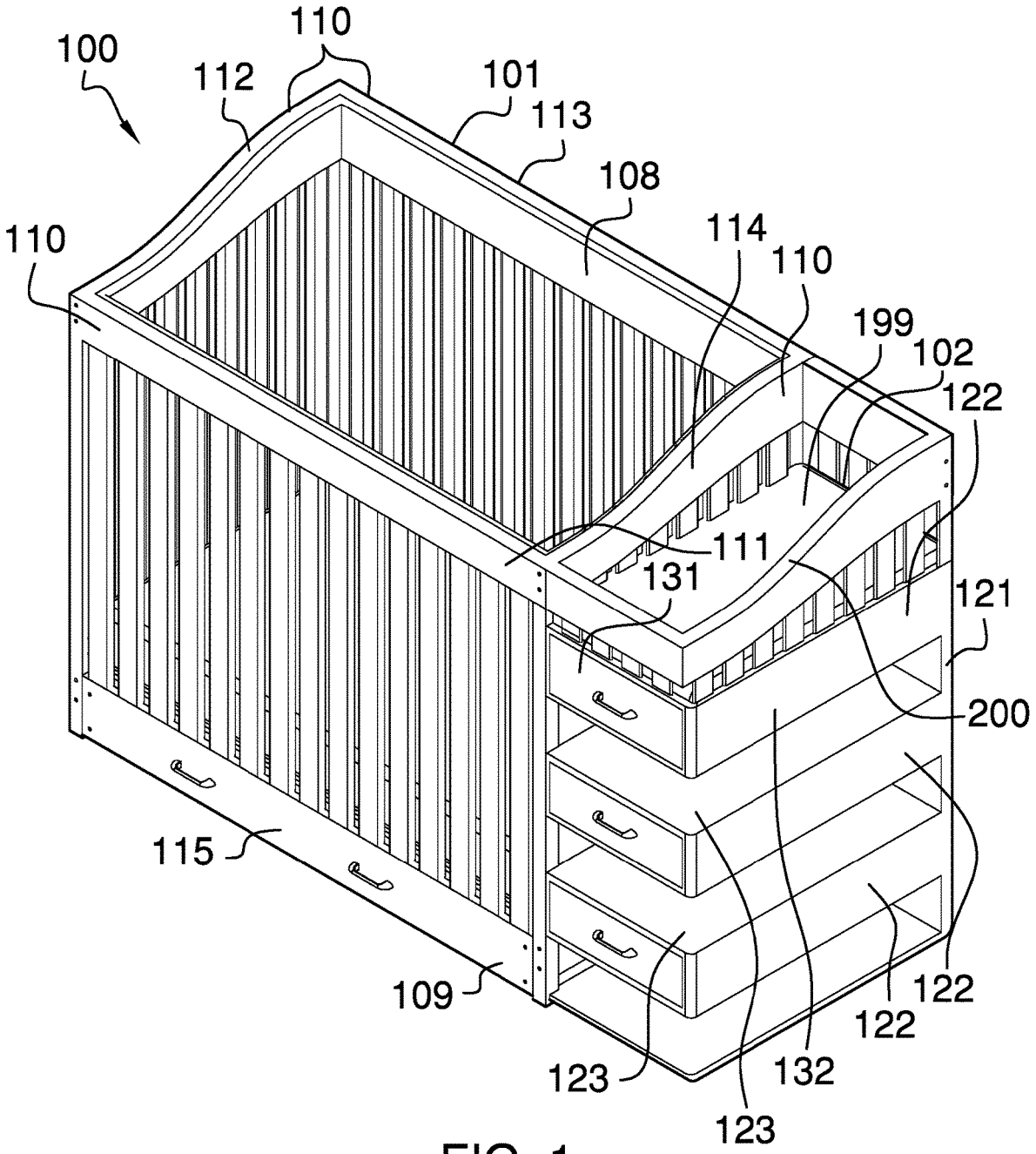
FIG. 1 is a perspective view of an embodiment of the disclosure.
Figure 2:
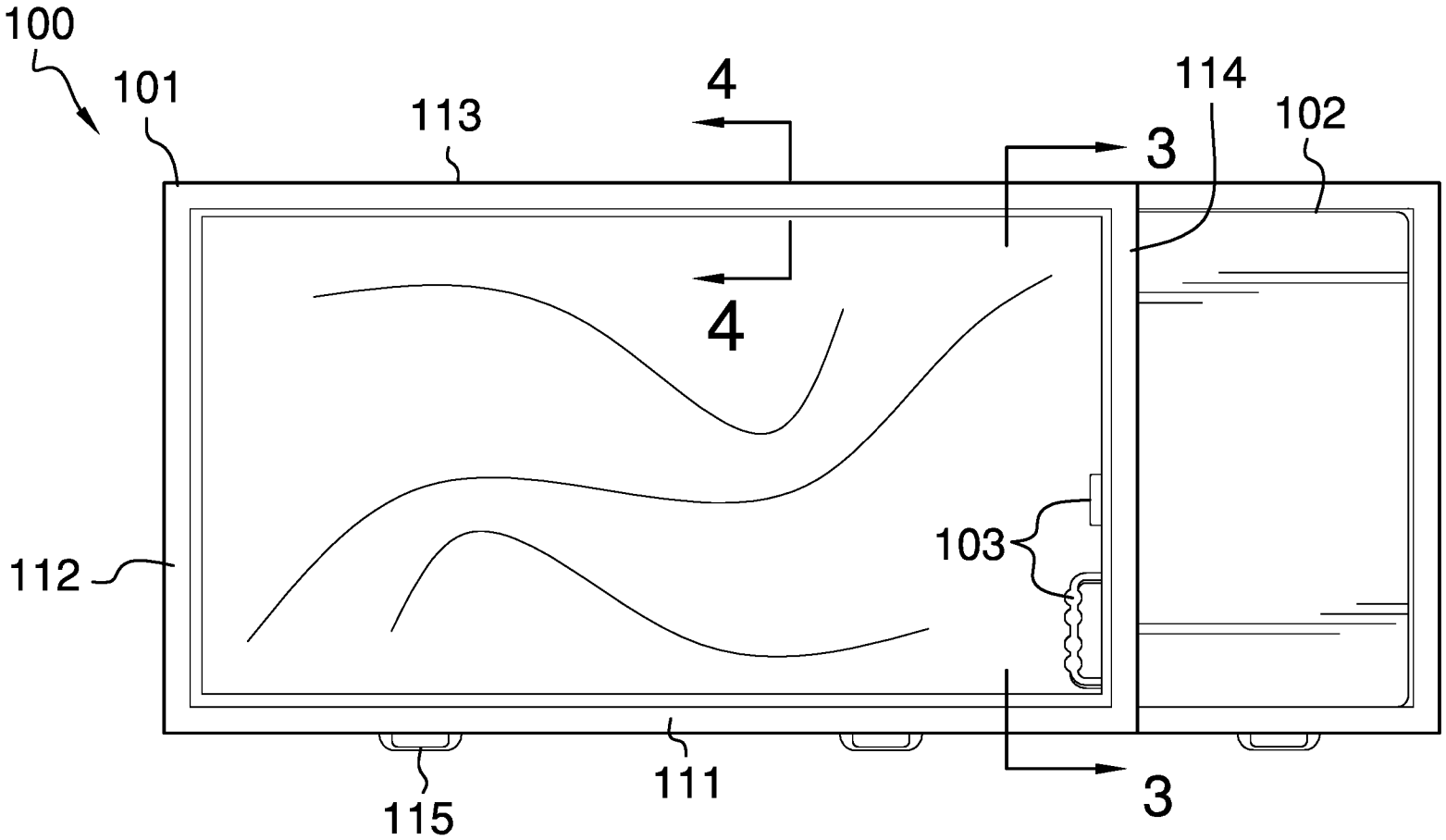
FIG. 2 is a top view of an embodiment of the disclosure.
Figure 3:
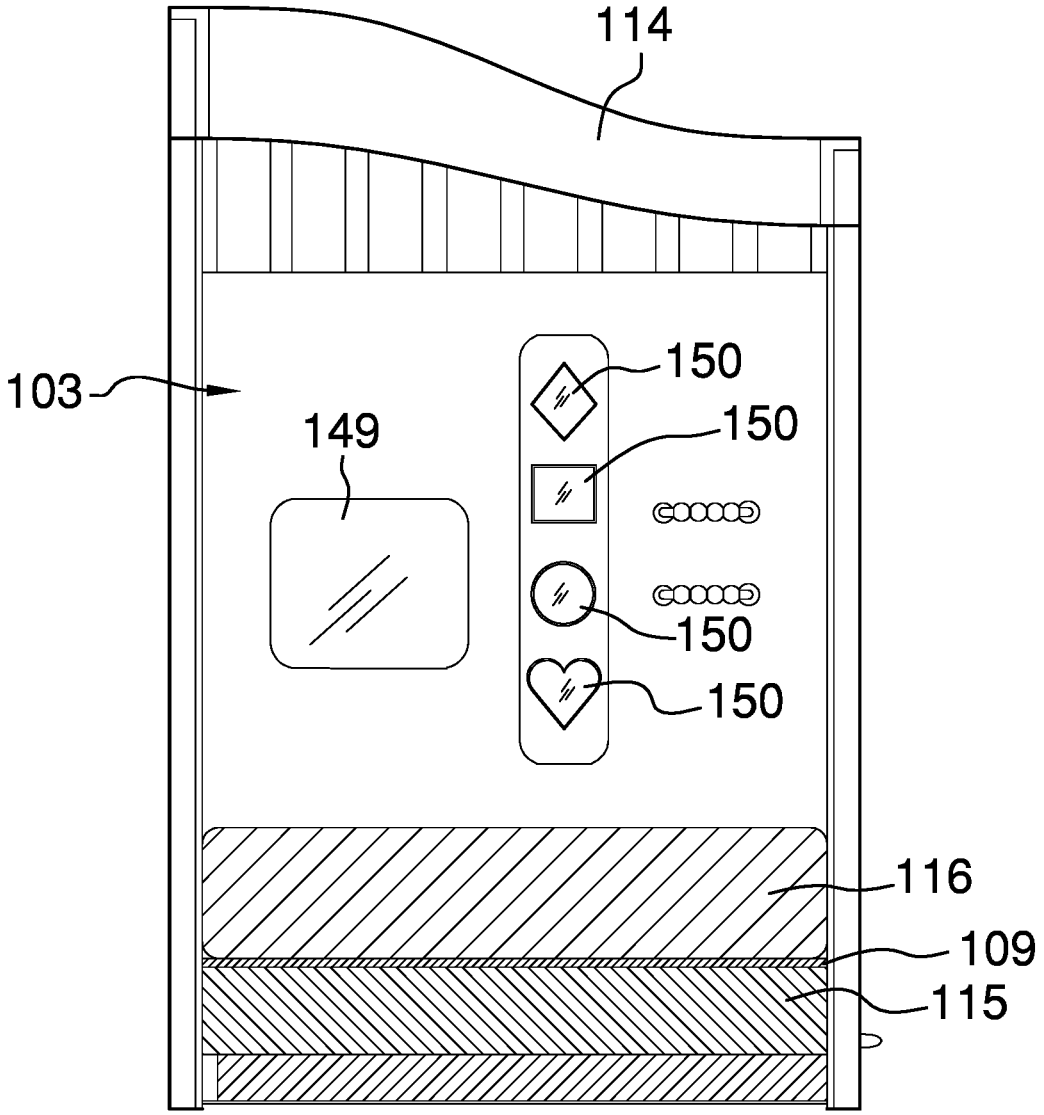
FIG. 3 is a cross-sectional view of an embodiment of the disclosure across 3-3 as shown in FIG. 2.
Figure 4:
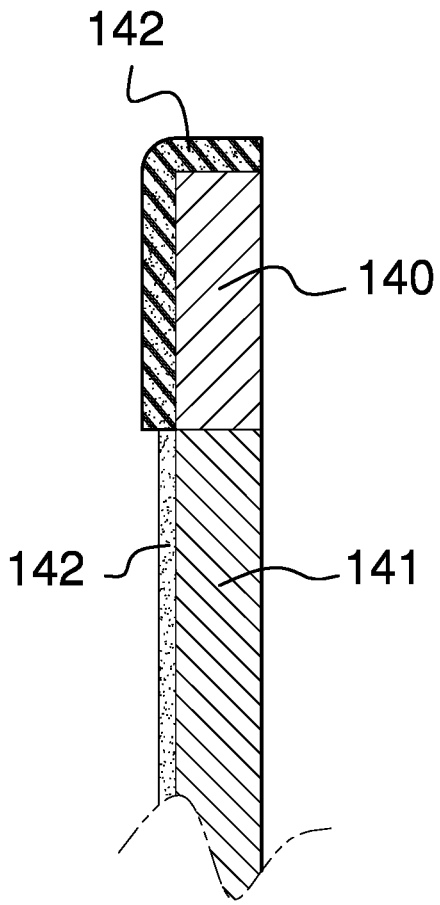
FIG. 4 is a cross-sectional view of an embodiment of the disclosure across 4-4 as shown in FIG. 2.
Figure 5:
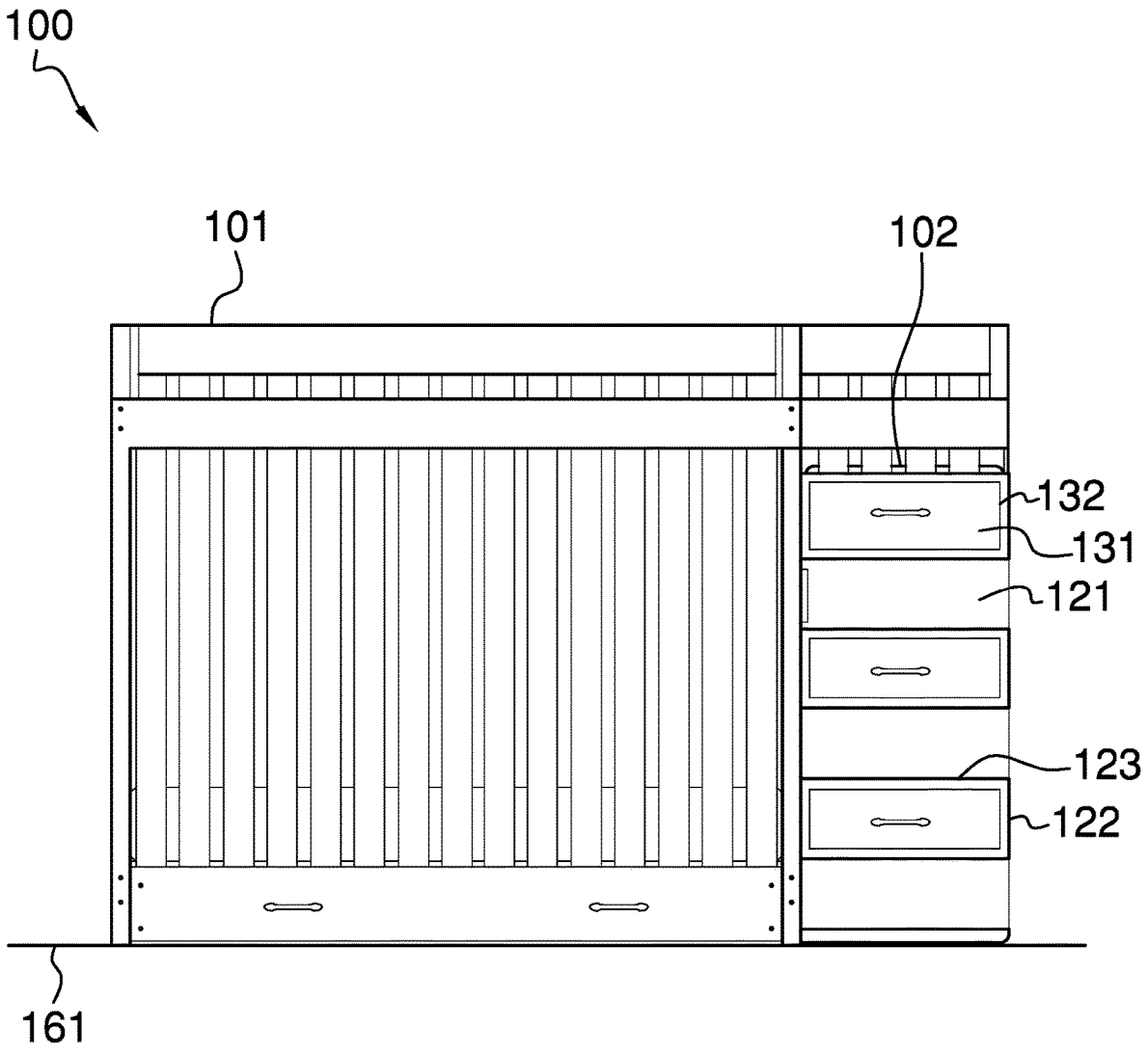
FIG. 5 is a front view of an embodiment of the disclosure.
Figure 6:
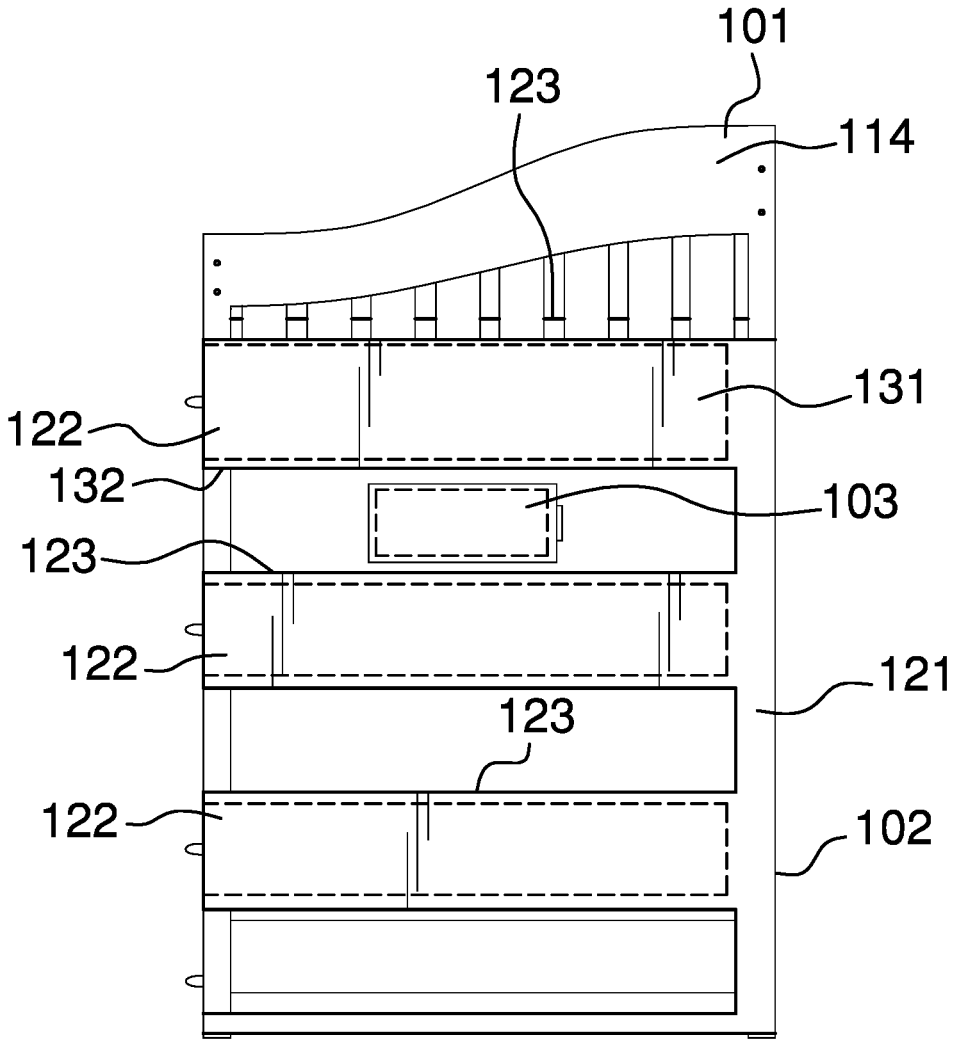
FIG. 6 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The infant crib with safety measures integrated therein 100 (hereinafter invention) is an item of furniture adapted for use with a child. The invention 100 comprises a crib 101, an end cabinet 102, and an entertainment center 103. The invention 100 is designed to sit directly on a supporting surface 161 such that the severity and risk of a fall are reduced. The supporting surface 161 is a horizontal surface that is used to support the invention 100. In the first potential embodiment of the disclosure, the supporting surface 161 is assumed to be a floor within a residential building. The interior surfaces of the pen 108 of the crib 101 are lined with a padding 142 that reduces the probability of an impact injuries. The padding 142 further reduces injury risk by discouraging chewing along the edges of the invention 100. The end cabinet 102 provides storage space for used near the invention 100. The entertainment center 103 is a collection of stimuli that aid in a child's development.

The crib 101 is a comfortable and secure chamber within which an infant is placed. The crib 101 comprises a pen 108, a base structure 109, and a plurality of guardrails 110. The pen 108 is a five-sided hollow structure. The interior of the pen 108 forms the chamber into which the infant is placed. The base structure 109 is a rectangular block structure that forms the bottom horizontal surface of the pen 108. The base structure 109 further serves the purpose of a storage cabinet. Each of the plurality of guardrails 110 forms a vertical side of the pen 108. Each of the plurality of guardrails 110 comprises a perimeter frame 140, a plurality of slats 141 and a padding 142. The plurality of slats 141 are attached to the perimeter frame 140. The padding 142 is attached to both the plurality of slats 141 and the perimeter frame 140.

The perimeter frame 140 is a rectangular structure that forms the perimeter of each of the plurality of guardrails 110. The purpose of the perimeter frame 140 is to hold together and provide stability of each of the plurality of slats 141 used in the construction of any guardrail selected from the plurality of guardrails 110.

Each of the plurality of slats 141 is a rectangular plank that forms the primary surface of any guardrail selected from the plurality of guardrails 110 and, by implication the plurality of slats 141 forms the primary vertical surfaces of the pen 108.

The plurality of guardrails 110 further comprises a first guard 111, a second guard 112, a third guard 113, and a first end 114. The first guard 111, the second guard 112, the third guard 113 use the same construction techniques but can have differing dimensions for the perimeter frame 140. The plurality of slats 141 that form the first guard 111 are spaced such that no more than 0.40 inches (1.0 cm) of space exists between any two adjacent slats selected from the plurality of slats 141. This spacing is adequate to prevent injuries caused by body parts being trapped between any two adjacent slats. The plurality of slats 141 that form the first end 114 of the pen 108 are placed edge to edge such that no space exists between any two adjacent slats selected from the pen 108. This spacing prevents injuries caused by body parts being trapped between any two adjacent slats.

The padding 142 is a cushion material. The padding 142 is attached to each slat contained within the plurality of slats 141 of each guardrail selected from the plurality of guardrails 110. The padding 142 is attached to the surface of each slat selected from each of the plurality of slats 141 that forms the interior surface of the pen 108.

The padding 142 is attached to each perimeter frame 140 that forms each guardrail selected from the plurality of guardrails 110. The padding 142 is attached to surface of each perimeter frame 140 that forms the interior surface of the pen 108. In the first potential embodiment of the disclosure, the padding 142 is formed from a silicone gel. The silicone gel is selected because of its non-toxic nature.

The base structure 109 comprises a base drawer 115 and a mattress 116. The base drawer 115 is a drawer that is built into the base structure 109 for storage purposes. Methods to install drawers in cabinets are well known and documented in the carpentry arts. The mattress 116 is a readily and commercially available mattress that is placed on the top horizontal surface of the base structure 109.

The end cabinet 102 is a structure that is attached to the invention 100. The purpose of the end cabinet 102 is to provide a storage space that is proximal to the invention 100. The end cabinet 102 comprises a backboard 121, a plurality of drawers 122, and a plurality of shelves 123. The end cabinet 102 is further defined with a changing surface 199. The changing surface 199 sits atop of the plurality of shelves 123. Moreover, the changing surface 199 includes a perimeter rail 200 that corresponds with the plurality of guide rails 110.

The backboard 121 is a rectangular plate structure upon which the plurality of drawers 122 are attached.

Each of the plurality of drawers 122 comprises a drawer 131 and a drawer mount 132. The drawer mount 132 is a hollow cabinet that is formed in the shape of a rectangular block. The drawer mount 132 further comprises the hardware necessary to mount the drawer 131 within the drawer mount 132. The top horizontal surface of the drawer mount 132 forms a shelf selected from the plurality of shelves 122. The drawer 131 is a storage container that is designed to slide into and out of the drawer mount 132. Methods to make drawers are well known and documented in the cabinetry arts.

The side of each drawer mount 132 selected from the plurality of drawers 122 is attached to the first end 114 of the crib 101 for the purpose of attaching the end cabinet 102 to the crib 101.

In the first potential embodiment of the disclosure, a vertical spacing is formed between any two adjacent drawer mount 132 selected from the plurality of drawers 122 for the purpose of providing access to the top horizontal surface formed by each drawer mount 132 selected from the plurality of drawers 122. The plurality of shelves 123 of the end cabinet 102 is a storage space that formed by the top horizontal surface of each drawer mount 132 selected from the plurality of drawers 122.

The entertainment center 103 is a collection of stimuli that are intended to entertain and stimulate the development of the infant. The entertainment center 103 comprises an AC/DC converter 148, a mirror 149, and a plurality of lighting circuits 150.

The AC/DC converter 148 is a readily and commercially available electrical device. The AC/DC converter 148 is an electrical device that converts an AC voltage into a DC voltage. Method to design and build AC/DC converters are well known in the electrical arts. The mirror 149 is a non-breakable mirror 149. In the first potential embodiment of the disclosure, the mirror 149 is formed as a silvered plate that is encased within a transparent block formed from poly(methyl methacrylic). The mirror 149 is mounted on the interior surface of the first end 114.

Each of the plurality of lighting circuits 150 is an electrical circuit that, when activated by a switch 155, will light an LED 153 for a predetermined period of time. In the first potential embodiment of the disclosure, each of the plurality of lighting circuits 150 is mounted within a decorative housing that is intended to provide further stimulation. Each of the plurality of lighting circuits 150 is mounted on the interior surface of the pen 108. The plurality of lighting circuits 150 comprises a first limit resistor 151, a second limit resistor 152, an LED 153, a timing circuit 154, and a switch 155. The first limit resistor 151 is further defined with a first lead 171 and a second lead 172. The second limit resistor 152 is further defined with a third lead 173 and a fourth lead 174. The switch 155 is further defined with a fifth lead 175 and a sixth lead 176. The LED 153 is further defined with an anode 177 and a cathode 178. The timing circuit 154 is further defined with a trigger 179 and an output 180.

The first limit resistor 151 is a readily and commercially available resistor. The purpose of the first limit resistor 151 is to limit current flow through the selected lighting circuit. The second limit resistor 152 is a readily and commercially available resistor. The purpose of the second limit resistor 152 is to limit current flow through the selected lighting circuit. The LED 153 is a readily and commercially available light emitting diode 153. The switch 155 is a readily and commercially available momentary switch. The switch 155 is mounted within the decorative housing such that the switch 155 is accessible from the exterior of the decorative housing.

The timing circuit 154 is an electrical circuit that generates an electrical voltage that illuminates the LED 153 for a predetermined period of time. Methods to design and use timing circuits are well known in the electrical arts. In the first potential embodiment of the disclosure, the timing circuit 154 is a readily, commercially available, and well documented "555" timing chip. The trigger 179 is an input to the timing circuit 154 that initiates the operation of the timing circuit 154. The output 180 is an output of the timing circuit 154 that powers the illumination of the LED 153.

The entertainment center 103 further comprises an external power source 147. The external power source 147 is an externally provided source of electrical power. In the first potential embodiment of the disclosure, the external power source 147 is the national electric grid. Alternatively a battery can be used.

Figure 7:
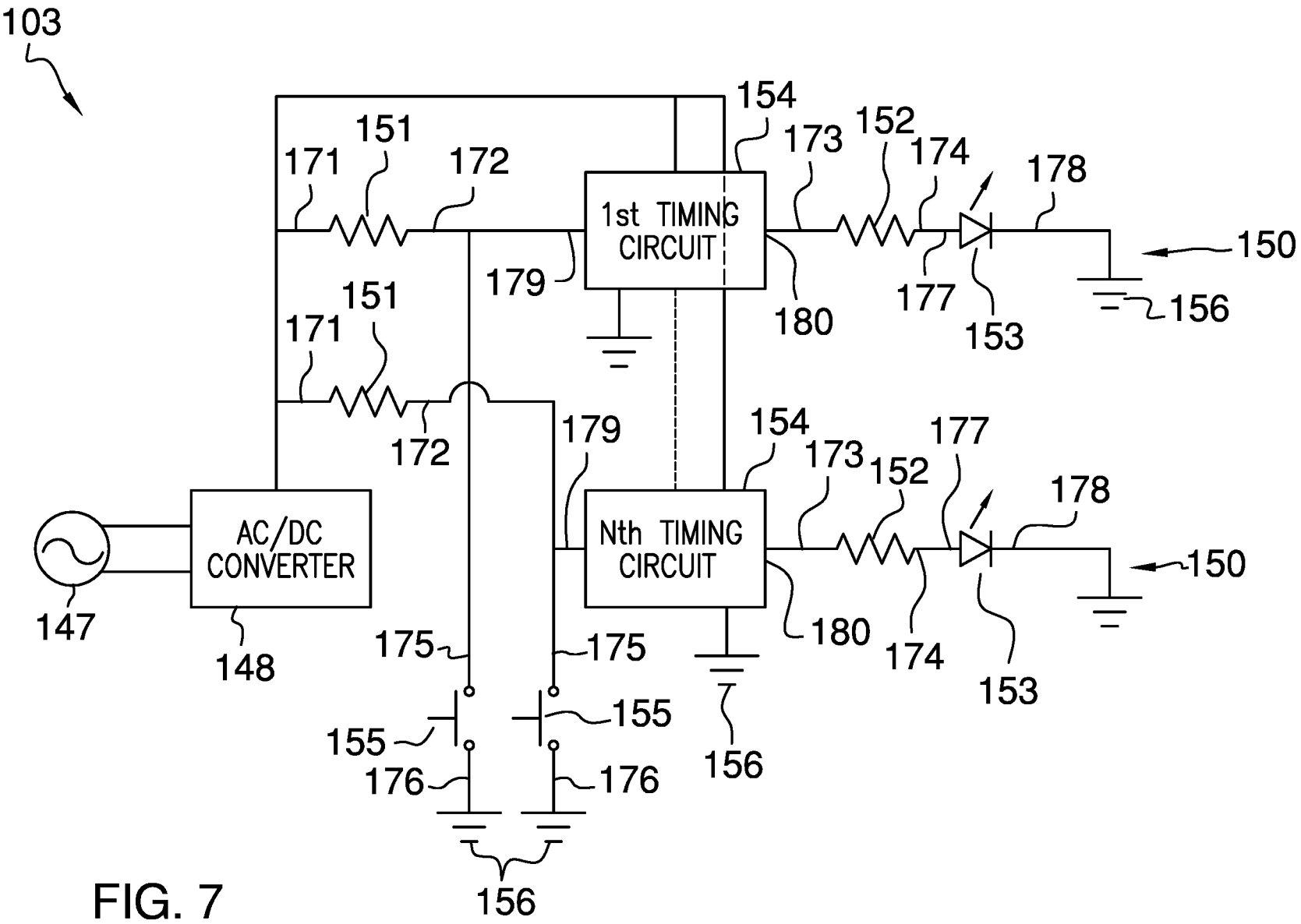
FIG. 7 is a schematic view of an embodiment of the disclosure.

As shown most clearly in FIG. 7, the AC/DC converter 148 is electrically connected to and draws power from the external power source 147. The AC/DC converter 148 further powers each of the timing circuit 154 contained within each of the plurality of lighting circuits 150. For each of the plurality of lighting circuits 150 the powered lead of the AC/DC converter 148 is further electrically connected to the first lead 171 of the first limit resistor 151. The second lead 172 of the first limit resistor 151 is electrically connected to the trigger 179 of the timing circuit 154. The second lead 172 of the first limit resistor 151 is further electrically connected to the fifth lead 175 of the switch 155. The sixth lead 176 of the switch 155 is electrically connected to the electrical ground 156 of the circuit. The electrical ground 156 is a common reference voltage that is used in the design of electrical circuits.

An electrical ground 156 is often, but not necessarily, the discharge point of electric currents flowing through an electric circuit. The output 180 of the timing circuit 154 is electrically connected to the third lead 173 of the second limit resistor 152. The fourth lead 174 of the third lead 173 is electrically connected to the anode 177 of the LED 153. The cathode 178 of the LED 153 is electrically connected to the electrical ground 156 of the circuit. The plurality of lighting circuits 150 is mounted on the first end 114 of the crib 101 such that the plurality of lighting circuits 150 are accessible from the interior of the crib 101.

The following definitions were used in this disclosure:

AC: As used in this disclosure, AC is an acronym for alternating current.

AC/DC Converter: As used in this disclosure, an AC/DC converter is an electrical device that converts an AC voltage into a DC voltage. Method to design and build AC/DC converters are well known in the electrical arts.

Anodes and Cathodes: As used in this disclosure, an anode and a cathode are the connecting terminals of an electrical circuit element or device. Technically, the cathode is the terminal through which the physical electrons flow into the device. The anode is the terminal through which the physical electrons flow out of the device. As a practical matter the anode refers to: 1) the positive terminal of a power consuming electrical circuit element; 2) the negative terminal of a discharging battery or an electrical power source; and, 3) the positive terminal of a charging battery. As a further practical matter the cathode refers to: 1) the negative terminal of a power consuming electrical circuit element; 2) the positive terminal of a discharging battery or an electrical power source; and, 3) the negative terminal of a charging battery.

Cushion: As used in this disclosure a cushion is a pad or pillow formed from soft material that is used for resting, sleeping, or reclining.

DC: As used in this disclosure, DC is an acronym for direct current.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Diode: As used in this disclosure, a diode is a two terminal semiconductor device that allows current flow in only one direction. The two terminals are called the anode and the cathode. Electric current is allowed to pass from the anode to the cathode.

Drawer: As used in this disclosure, a drawer is a storage compartment that is designed to slide into and out of a larger object.

Exterior: As used in this disclosure, the exterior is use as a relational term that implies that an object is not contained within the boundary of a structure or a space.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Interior: As used in this disclosure, the interior is use as a relational term that implies that an object is contained within the boundary of a structure or a space.

LED: As used in this disclosure, an LED is an acronym for a light emitting diode. A light emitting diode is a diode that is also a light source.

Momentary Switch: As used in this disclosure, a momentary switch is a biased switch in the sense that the momentary switch has a baseline position that only changes when the momentary switch is actuated (for example when a pushbutton switch is pushed). The momentary switch then returns to the baseline position once the actuation is completed. This baseline position is called the "normal" position. So for example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

National Electric Grid: As used in this disclosure, the national electric grid is a synchronized and highly interconnected electrical network that distributes energy in the form of electric power from a plurality of generating stations to consumers of electricity.

Perimeter: As used in this disclosure, a perimeter is one or more curved or straight lines that bounds an enclosed area on a plane or surface. The perimeter of a circle is commonly referred to as a circumference.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Timing Circuit: As used in this disclosure, a timing circuit refers to an electrical network of interconnected electrical elements, potentially including but not limited to, resistors, capacitors, diodes, transistors, and integrated circuit devices. The purpose of the timing circuit is to generate an electrical control signal after a predetermined amount of time. In common usage, a timing circuit is also referred to as timing circuitry.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An item of nursery furniture comprising:
a crib, an end cabinet, and an entertainment center;
wherein the end cabinet attaches to the crib;
wherein the entertainment center attaches to the crib;
wherein the item of nursery furniture is an item of furniture adapted for use with a child;
wherein an interior surfaces of a pen of the crib are lined with a padding;
wherein the entertainment center is a collection of stimuli that aid in a child's development;
wherein the crib forms a chamber;
wherein the crib comprises the pen, a base structure, and a plurality of guardrails;
wherein the pen is a five sided hollow structure;
wherein the base structure and the plurality of guardrails form the sides of the pen;
wherein the base structure sits directly on a supporting surface;
wherein the supporting surface is a horizontal surface;
wherein the plurality of guardrails further comprises a first guard, a second guard, a third guard, and a first end;
wherein the end cabinet is a structure that is attached to the first end;
wherein the end cabinet comprises a backboard, a plurality of drawers, and a plurality of shelves;
wherein the backboard is a rectangular plate structure upon which the plurality of drawers are attached;
wherein each of the plurality of shelves are interlaced between each of the plurality of drawers;
wherein the end cabinet is further defined with a changing surface;
wherein the changing surface sits atop of the plurality of shelves;
wherein the changing surface includes a perimeter rail that corresponds with the plurality of guide rails.

2. The item of nursery furniture according to claim 1
wherein the base structure is a rectangular block structure;
wherein the base structure forms a bottom horizontal surface of the pen;
wherein each of the plurality of guardrails forms a vertical side of the pen.

3. The item of nursery furniture according to claim 2
wherein each of the plurality of guardrails comprises a perimeter frame, a plurality of slats and the padding;
wherein the plurality of slats are attached to the perimeter frame;
wherein the padding is attached to both the plurality of slats and the perimeter frame.

4. The item of nursery furniture according to claim 3
wherein the perimeter frame is a rectangular structure that forms the perimeter of each of the plurality of guardrails;
wherein each of the plurality of slats is a rectangular plank;
wherein each of the plurality of slats combine to form a primary vertical surfaces of the pen.

5. The item of nursery furniture according to claim 4
wherein the plurality of slats that form the first guard are spaced such that no more than 0.4 inches (1.0 cm) of space exists between any two adjacent slats selected from the plurality of slats;
wherein the plurality of slats that form the second guard are spaced such that no more than 0.4 inches (1.0 cm) of space exists between any two adjacent slats selected from the plurality of slats;
wherein the plurality of slats that form the third guard are spaced such that no more than 0.4 inches (1.0 cm) of space exists between any two adjacent slats selected from the plurality of slats.

6. The item of nursery furniture according to claim 5 wherein the plurality of slats that form the first end of the pen are placed edge to edge such that no space exists between any two adjacent slats selected from the pen.

7. The item of nursery furniture according to claim 6
wherein the padding is a cushion material;
wherein the padding is attached to each slat contained within the plurality of slats of each guardrail selected from the plurality of guardrails;
wherein the padding is attached to the surface of each slat selected from each of the plurality of slats that forms the interior surface of the pen.

8. The item of nursery furniture according to claim 7
wherein the padding is attached to each perimeter frame that forms each guardrail selected from the plurality of guardrails;
wherein the padding is attached to surface of each perimeter frame that forms the interior surface of the pen.

9. The item of nursery furniture according to claim 8 wherein the padding is formed from a silicone gel.

10. The item of nursery furniture according to claim 9
wherein the base structure comprises a base drawer and a mattress;
wherein the base drawer is a drawer is built into the base structure;
wherein the mattress is placed on the top horizontal surface of the base structure.

11. The item of nursery furniture according to claim 10
wherein each of the plurality of drawers comprises a drawer and a drawer mount;
wherein the drawer mount is a hollow cabinet that is formed in the shape of a rectangular block;
wherein the drawer is a storage container that is designed to slide into and out of the drawer mount.

12. The item of nursery furniture according to claim 11
wherein the side of each drawer mount selected from the plurality of drawers is attached to the first end of the crib for the purpose of attaching the end cabinet to the crib;
wherein a vertical spacing is formed between any two adjacent drawer mount selected from the plurality of drawers;
wherein the plurality of shelves of the end cabinet is a storage space that formed by the top horizontal surface of each drawer mount selected from the plurality of drawers.

13. The item of nursery furniture according to claim 12
wherein the entertainment center comprises an AC/DC converter, a mirror, and a plurality of lighting circuits;
wherein the AC/DC converter is an electrical device that converts an AC voltage into a DC voltage;
wherein the mirror is a non-breakable mirror;
wherein the mirror is formed as a silvered plate that is encased within a transparent block;
wherein the mirror is mounted on the interior surface of the pen;
wherein each of the plurality of lighting circuits is an electrical circuit that lights an LED for a predetermined period of time;
wherein each of the plurality of lighting circuits is mounted within a decorative housing;
wherein each of the plurality of lighting circuits is mounted on the interior surface of the pen.

14. The item of nursery furniture according to claim 13
wherein the plurality of lighting circuits comprises a first limit resistor, a second limit resistor, an LED, a timing circuit, and a switch;
wherein the first limit resistor, the second limit resistor, the LED, the timing circuit, and the switch are electrically interconnected;
wherein the first limit resistor is further defined with a first lead and a second lead;
wherein the second limit resistor is further defined with a third lead and a fourth lead;
wherein the switch is further defined with a fifth lead and a sixth lead;
wherein the LED is further defined with an anode and a cathode;
wherein the timing circuit is further defined with a trigger and an output.

15. The item of nursery furniture according to claim 14
wherein the switch is a momentary switch;
wherein the switch is mounted within the decorative housing such that the switch is accessible from the exterior of the decorative housing;
wherein the timing circuit is an electrical circuit that is triggered by the switch;
wherein the trigger is an input to the timing circuit that initiates the operation of the timing circuit;
wherein the output of the timing circuit generates an electrical voltage that illuminates the LED for a predetermined period of time.

16. The item of nursery furniture according to claim 15
wherein for each of the plurality of lighting circuits the powered lead of the AC/DC converter is further electrically connected to the first lead of the first limit resistor;
wherein for each of the plurality of lighting circuits the second lead of the first limit resistor is electrically connected to the trigger of the timing circuit;
wherein for each of the plurality of lighting circuits the second lead of the first limit resistor is further electrically connected to the fifth lead of the switch;
wherein for each of the plurality of lighting circuits the sixth lead of the switch is electrically connected to the electrical ground of the circuit;
wherein for each of the plurality of lighting circuits the output of the timing circuit is electrically connected to the third lead of the second limit resistor;
wherein for each of the plurality of lighting circuits the fourth lead of the third lead is electrically connected to the anode of the LED;
wherein for each of the plurality of lighting circuits the cathode of the LED is electrically connected to the electrical ground of the circuit.

17. The item of nursery furniture according to claim 16
wherein the AC/DC converter is electrically connected to and draws power from an external power source;
wherein the AC/DC converter further powers each timing circuit contained within each of the plurality of lighting circuits.

18. The item of nursery furniture according to claim 17
wherein the timing circuit is a "555" timing chip.

* * * * *